United States Patent [19]

Goria

[11] Patent Number: 4,712,319

[45] Date of Patent: Dec. 15, 1987

[54] FOOTWEAR WITH DETACHABLE VISIBILITY AIDS

[76] Inventor: Luigi Goria, Via Montosolo 8, 10025 Pino Torinese (Torino), Italy

[21] Appl. No.: 881,982

[22] Filed: Jul. 3, 1986

[30] Foreign Application Priority Data

Jul. 5, 1985 [IT] Italy ..... 53571/85[U]

[51] Int. Cl.[4] ..... A43B 23/00; G02B 5/12

[52] U.S. Cl. ..... 36/137; 36/1; 36/136; 350/98

[58] Field of Search ..... 36/137, 136, 1; 350/98

[56] References Cited

U.S. PATENT DOCUMENTS

| | | | |
|---|---|---|---|
| 1,583,274 | 5/1926 | Bostock | 36/136 |
| 2,473,877 | 6/1949 | Goldstein | 36/137 X |
| 2,489,368 | 11/1949 | Faybert | 36/1 X |
| 3,291,668 | 12/1966 | Goldstein | 36/1 X |
| 3,950,076 | 4/1976 | Carlson | 350/98 X |

FOREIGN PATENT DOCUMENTS

| | | | |
|---|---|---|---|
| 957102 | 1/1957 | Fed. Rep. of Germany | 36/137 |
| 2289135 | 5/1976 | France | 36/136 |
| 2417811 | 9/1979 | France | 36/137 |
| 7500494 | 1/1975 | Netherlands | 36/137 |
| 316806 | 8/1929 | United Kingdom | 350/98 |
| 1092482 | 11/1967 | United Kingdom | 36/137 |

*Primary Examiner*—James Kee Chi

*Attorney, Agent, or Firm*—Sughrue, Mion, Zinn, Macpeak & Seas

[57] ABSTRACT

Footwear with elastomeric or plastomeric soles, such as boots, sports footwear or leisure footwear, has distinguishing elements or decorations attached to it. The elements comprise a flanged body held by means of a flexible retaining element, which may be part of the footwear itself, which has an aperture therein for allowing the body to be visible while retaining the flange. The elements may be reflective, fluorescent, phosphorescent or photoluminescent.

1 Claim, 14 Drawing Figures

FOOTWEAR WITH DETACHABLE VISIBILITY AIDS

The present invention relates to footwear with elastomeric or plastomeric soles fixed by whatever means to the upper (vulcanisation in an autoclave, gluing, sewing, moulding or direct injection); such footwear being constituted particularly by boots, bootees, after-ski shoes, or sports footwear, for recreation and for leisure time.

The main characteristic of the footwear which constitutes the subject of the present invention lies in the fact that it has one or more added elements for increasing the visibility of the footwear itself; each of the elements comprising a body which has a peripheral flange and is retained by a thin flexible retaining element, adhering to the footwear and having an aperture arranged to allow the visibility of the body the flange whereof is gripped between the retaining element and the footwear.

By virtue of this characteristic, the footwear of the present invention enables greater safety to be achieved in that, with the use of added elements adapted to act as reflecting or cathadioptic elements, the person wearing them is more visible even at night, in the presence of light sources, while with the use of fluorescent, phosphorescent and photoluminescent elements visibility is improved in conditions of poor or zero illumination.

Furthermore, the elements added to the footwear could be of a shape and/or colour such as also to satisfy requirements of fashion and aesthetics, thus improving the appearance of the footwear.

Figure 1:
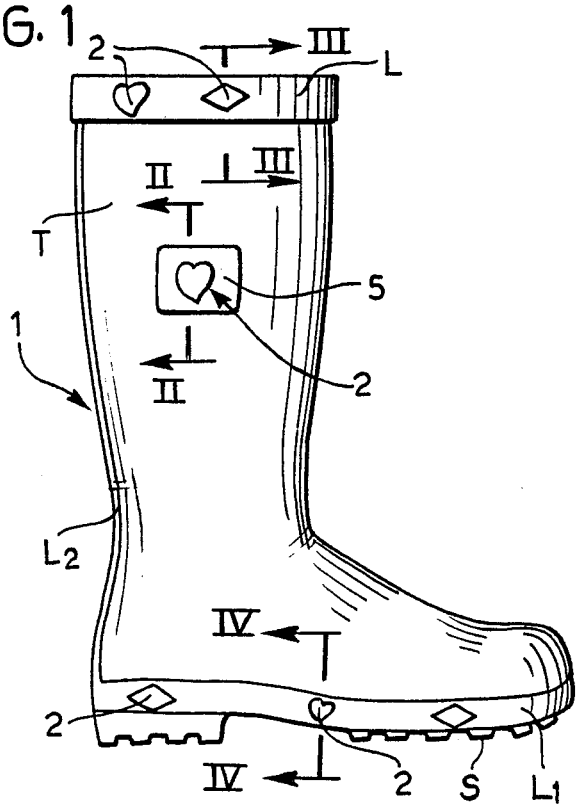
Figure 2:
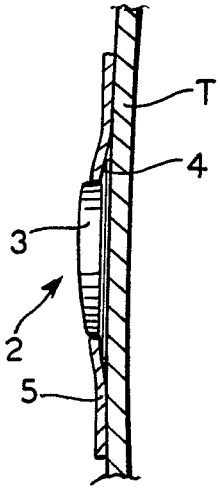
Figure 3:
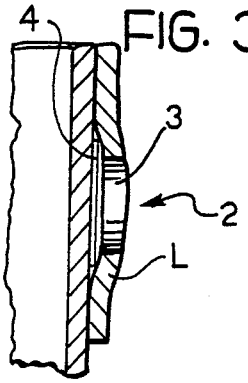
Figure 4:
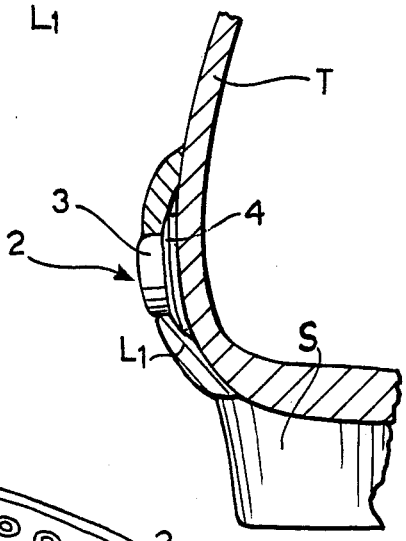
Figure 5:
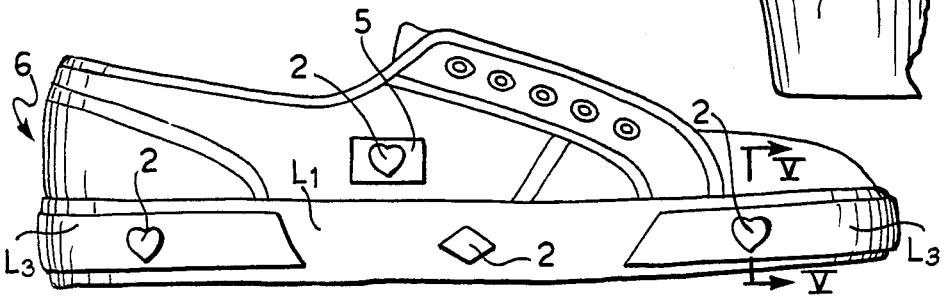
Figure 6:
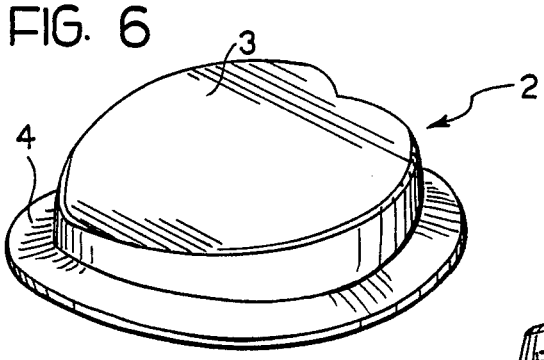
Figure 7:
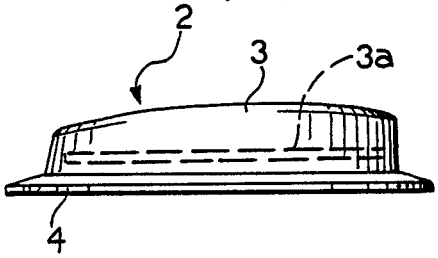
Figure 8:
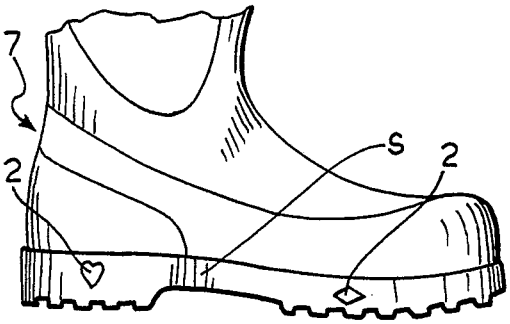
Figure 5B:
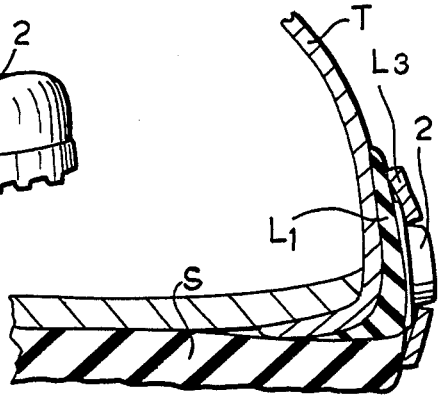
Figure 8B:
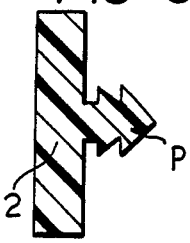
Figure 9:
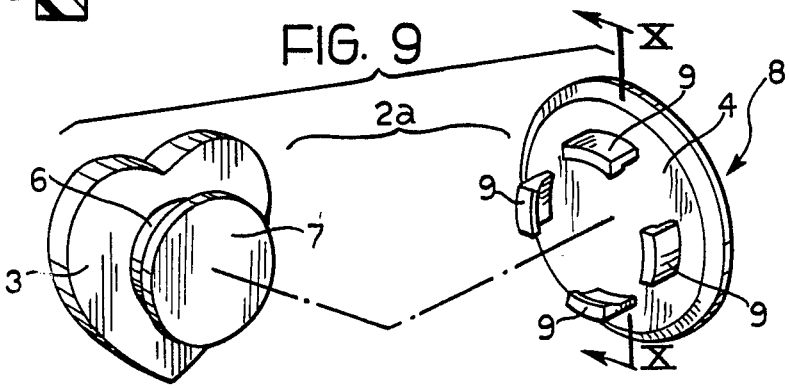
Figure 11:
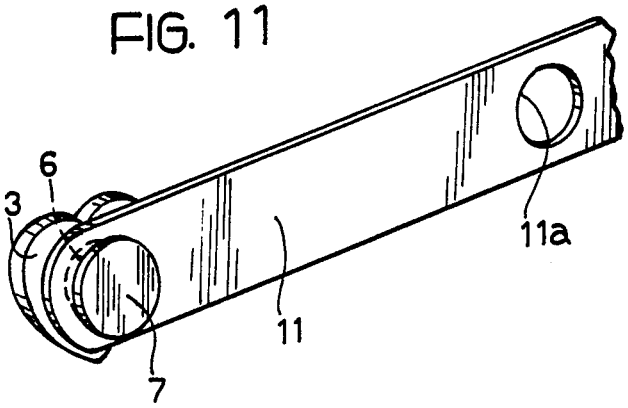
Figure 10:
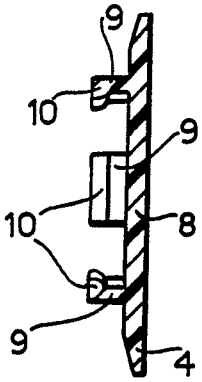
Figure 12:
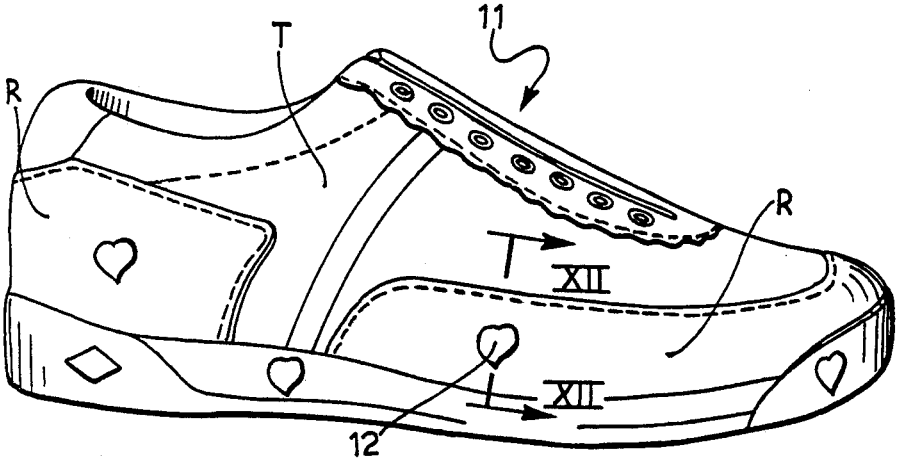
Figure 13:
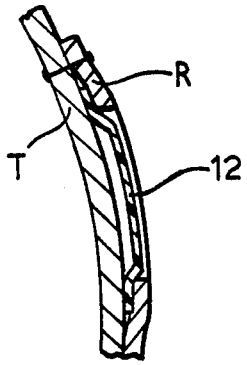
Figure 14:
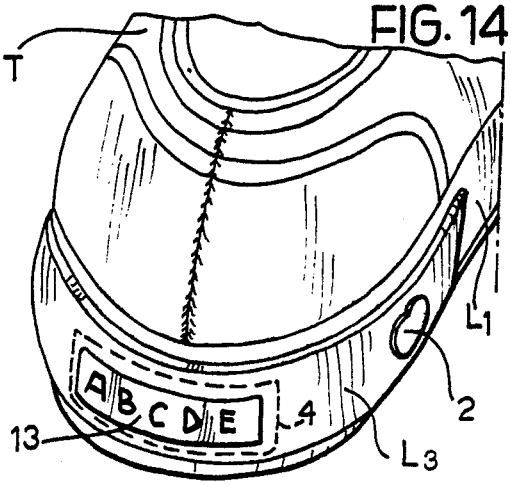

Further characteristics and advantages of the present invention will become apparent from the description which follows with reference to the appended drawings, provided purely by way of non-limiting example, in which:

FIG. 1 is a side view of a boot according to the present invention,

FIGS. 2, 3 and 4 are sections taken on the lines II—II, III—III and IV—IV of FIG. 1, on an enlarged scale, FIG. 5 is a side view of sports footwear for recreation or leisure time, according to the invention, FIG. 5 bis is a section taken on the line V bis—V bis of FIG. 5, FIG. 6 is a perspective view of one of the elements added to the footwear illustrated in FIGS. 1 and 5, FIG. 7 is a side view of the element illustrated in FIG. 6, FIG. 8 illustrates a variant of the boot illustrated in FIG. 1, FIG. 8 bis is a section of one of the elements applied to the boot of FIG. 8, on an enlarged scale, FIG. 9 is an exploded perspective view of a variant of the element illustrated in FIGS. 6 and 7, FIG. 10 is a cross section taken on the line X—X of FIG. 9, on an enlarged scale, FIG. 11 is a perspective view illustrating the connection between a strip of elements of the type illustrated in FIG. 9, FIG. 12 illustrates a variant of the footwear illustrated in FIG. 5, FIG. 13 is a cross section taken on the line XIII—XIII of FIG. 12, on an enlarged scale, and FIG. 14 is a perspective view of the rear part of footwear having an added element according to the invention.

With reference to FIGS. 1 to 4, a boot 1 is shown with an elastomeric or plastomeric sole S fixed to the upper T by vulcanisation in an autoclave. The band around the upper edge of the leg of the boot is indicated L and the outer band around the edge of the sole $L_1$ and the rear strip covering the leg seam is indicated $L_2$. The boot has added elements each of which is generally indicated 2 and comprises a body 3 with a peripheral flange 4. Each of the elements 2 is retained on the footwear by means of a thin flexible retaining element adhering to the footwear and having an aperture for allowing the visibility of the body 3, the flange 4 whereof is thus gripped between the retaining element and the footwear.

The flexible retaining element is constituted, for the elements 2 applied to the upper, by a flexible plate 5 (for example of rubber, textile or plastics material), adhering to the upper by any known means, for example by gluing.

In the case of the elements 2 located close to the upper edge of the leg of the boot, the flexible retaining element is constituted by the band L while in the case of the elements 2 located around the periphery of the sole, the retaining element is constituted by the band $L_1$. In the case of the application of elements 2 to the rear part of the boot, it could be advantageous to use the rear seam covering strip $L_2$ as the retaining element.

Both the element 5 and the bands L, $L_1$ and strip $L_2$ will each have an aperture with a periphery corresponding to that of the body 3 in order to retain it.

In the case of the footwear illustrated in FIG. 5, the plate elements 5 are used to retain the elements 2 in the case of the upper while, in the case of the sole, reinforcing strips $L_2$ are applied, on the outer strip $L_1$ of the edge of the sole.

The boot illustrated in FIG. 8 is of the type which does not have a band surrounding the edge of the sole.

In this case, (as also in the case of footwear with a microporous sole) the elements 2 applied to the periphery of the sole S are each provided, as shown in FIG. 8 bis, with an integral appendage P having a profile in the form of a fir tree which is a force fit in a hole in the sole.

The elements 2 illustrated in FIGS. 6 and 7 may conveniently be made from moulded plastics material and their periphery could have a form different from that of the heart illustrated purely by way of example.

The plastics material is preferably coloured and, by virtue of its reflecting properties, the added elements 2 increase the visibility of the footwear. The outer surface of the elements 2 could be flat, convex, concave or possibility faceted, with rear reflecting surfaces to increase the reflecting effect.

In order further to increase the visibility, the added elements will conveniently be made of a plastics material incorporating fluorescent, phosphorescent or photoluminescent pigments or of a plastics material with added cathadioptics.

Alternatively, the elements 2 could be moulded in transparent plastics material, there being incorporated in the body 3 a plate 3*a* bearing the phosphorescent or fluorescent pigments; or photoluminescent elements capable of absorbing any light and re-emitting it in darkness.

According to a further alternative, the body 2 could have prismatic or other formations such as lenticular formations made by moulding and such as to make it act itself as a cathadioptic.

In the variant illustrated in FIGS. 9 and 10, an added element 2a is shown which is constituted by two parts snap engageable with each other.

A first part is constituted by the body 3 which has a shank 6 and a head 7 while a second part is constituted by a plate 8, for example of disc shape, which forms the flange 4 and has appendages 9 with toothed edges 10 for snap engaging beneath the head 7 of the first part.

The body 3 could be any one of the types mentioned above, (reflecting, cathadioptic, fluorescent, phosphorescent, photoluminescent) and, by virtue of the snap coupling, could be replaced quickly, by another body of one of the other types or one having for example a different colour or shape.

The user could thus personalise the footwear and harmonise it with his clothing.

The snap engageable elements could also be used to fix strips or the like having a decorative function as well as a reflecting, cathadioptic, fluorescent, phosphorescent or photoluminescent function, to the footwear. These strips will previously have been provided with holes for engagement with each shank 6 between the body 3 and the head 7, as illustrated in FIG. 11, in which one of these strips is indicated 11 and its holes are indicated 11a.

The footwear illustrated in FIG. 12 is a variant of that illustrated in FIG. 5 in that reinforcing layers R are provided on the upper T.

In this case, the reinforcing layers (or any covering layers applied to the upper) act as flexible elements for retaining the elements 2 for increasing the visibility which, in the embodiment illustrated, are constituted by simple coloured plates 12. Instead of the plates 12, the elements described previously for increasing the visibility could be used.

The solution described above also lends itself to use with after-ski shoes provided with similar reinforcing layers.

In the variant illustrated in FIG. 14 a footwear is shown in which an added element 13 is applied to the edge of the sole in correspondence with the heel, in accordance with the invention and carries the mark under which the footwear is sold.

The element 13, in the form of a flanged plaque with a curved profile is an advantageous substitute for the usual rubber label applied to the heel, in that it may be formed as one of the types described above, that is with characteristics of fluorescence, phosphorescence, photoluminescence or with cathadioptic characteristics.

The footwear could be of sports type, for recreation and for leisure time or a bootee or after-ski footwear.

The same type of plaque, formed with a flat surface, could be applied to the outer surface of the upper.

Naturally, the principle of the invention remaining the same, the constructional details and forms of embodiment could be varied widely with respect to those described and illustrated purely by way of example without thereby departing from the scope of the present utility model.

What is claimed is:

1. In footwear of the type having an elastomeric sole portion and an upper portion secured together and means for increasing the visibility of the footwear secured thereto, the improvement comprising a first member adapted to be secured to said footwear, a second manner including said means for increasing the visibility of the footwear, fastener means detachably connecting said first and second members and securing means for securing said first member to said footwear, wherein said fastener means is comprised of a plurality of appendages integral with one of said members and extending outwardly thereform in a circle with each appendage having a toothed edge facing radially inwardly of said circle and a circular disk secured in spaced relation to the other of said members and adapted to be snapped into and out of engagement with said toothed edges.

* * * * *